US009700756B2

(12) United States Patent
Franche

(10) Patent No.: US 9,700,756 B2
(45) Date of Patent: Jul. 11, 2017

(54) BALANCE BOARD FOR EXERCISE AND PHYSICAL THERAPY

(71) Applicant: Chad Franche, Arlington Heights, IL (US)

(72) Inventor: Chad Franche, Arlington Heights, IL (US)

(73) Assignee: THERREX INNOVATIONS, LLC, Arlington Heights, IL (US)

( * ) Notice: Subject to any disclaimer, the term of this patent is extended or adjusted under 35 U.S.C. 154(b) by 0 days.

(21) Appl. No.: 15/148,079

(22) Filed: May 6, 2016

(65) Prior Publication Data

US 2016/0325135 A1 Nov. 10, 2016

Related U.S. Application Data

(60) Provisional application No. 62/158,081, filed on May 7, 2015.

(51) Int. Cl.

| | |
|---|---|
| ***A63B 21/00*** | (2006.01) |
| ***A63B 22/16*** | (2006.01) |
| ***A63B 71/00*** | (2006.01) |
| ***A63B 21/068*** | (2006.01) |
| ***A63B 22/18*** | (2006.01) |
| ***A63B 26/00*** | (2006.01) |
| *A63B 23/12* | (2006.01) |

(52) U.S. Cl.

CPC ..... *A63B 22/16* (2013.01); *A63B 21/068* (2013.01); *A63B 21/4034* (2015.10); *A63B 22/18* (2013.01); *A63B 26/003* (2013.01); *A63B 71/0054* (2013.01); *A63B 21/4035* (2015.10); *A63B 23/1236* (2013.01); *A63B 2071/0072* (2013.01); *A63B 2208/0204* (2013.01)

(58) Field of Classification Search

USPC ..... 482/1–148

See application file for complete search history.

(56) References Cited

U.S. PATENT DOCUMENTS

| | | | | |
|---|---|---|---|---|
| 4,191,371 | A * | 3/1980 | Armer, Jr. | A63B 21/0004 482/146 |
| 4,759,542 | A * | 7/1988 | Hudec | A63B 22/16 482/146 |
| 4,826,159 | A * | 5/1989 | Hersey | A63B 26/003 482/146 |
| 5,048,823 | A * | 9/1991 | Bean | A63B 21/0004 482/146 |
| 5,643,164 | A * | 7/1997 | Teff | A61H 1/0266 482/146 |
| 5,897,474 | A * | 4/1999 | Romero | A63B 22/14 446/396 |
| 6,666,797 | B1 * | 12/2003 | Martin | A63B 69/0093 482/146 |

(Continued)

*Primary Examiner* — Stephen Crow

(74) *Attorney, Agent, or Firm* — Bishop Diehl & Lee, Ltd.

(57) ABSTRACT

A balance board which allows a user to move through a full range of motion without dismounting the board. Movement along a frontal plane as well as along a sagittal plane can be achieved using the disclosed board. Further, stops help stabilize the board and allow easier mounting and dismounting of the board. Finally, with hand openings the board can also be used in a prone position with the stops preventing impact by a user's hands/fingers with the ground surface during use.

11 Claims, 10 Drawing Sheets

(56) References Cited

U.S. PATENT DOCUMENTS

| | | | | |
|---|---|---|---|---|
| 6,945,920 | B1 * | 9/2005 | Kemery | A63B 21/0004 482/146 |
| 7,537,555 | B2 * | 5/2009 | Soletski | A63B 22/16 482/142 |
| 7,632,218 | B2 * | 12/2009 | Sannes | A63B 22/18 482/146 |
| 7,775,952 | B1 * | 8/2010 | Curran | A63B 22/18 482/146 |
| 7,857,740 | B2 * | 12/2010 | Suaste | A63B 21/0004 482/142 |
| D648,403 | S * | 11/2011 | Hanifee | D21/688 |
| D659,776 | S * | 5/2012 | Zydiak | D21/688 |
| 8,864,639 | B2 * | 10/2014 | Brown | A63B 22/16 482/143 |
| 9,005,091 | B2 * | 4/2015 | Brown | A63B 22/16 482/146 |
| 9,079,072 | B2 * | 7/2015 | Agostini | A63B 22/18 |
| 2004/0009859 | A1 * | 1/2004 | Gottlieb | A63B 21/0004 482/146 |
| 2012/0270193 | A1 * | 10/2012 | Piercey | A63B 69/0093 434/247 |

* cited by examiner

Fig. 1A
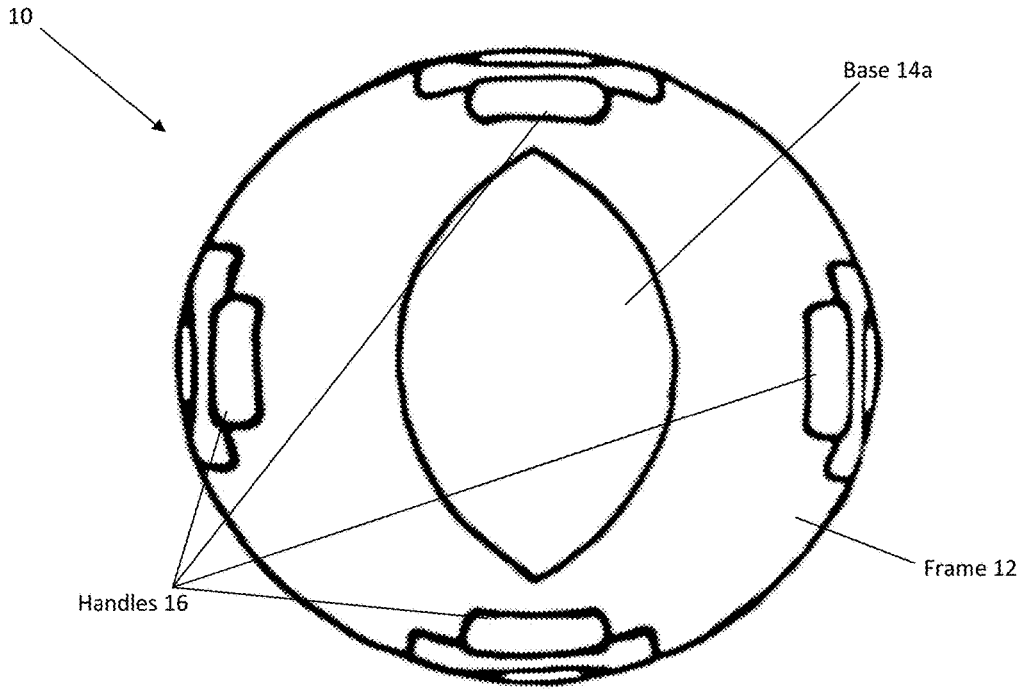
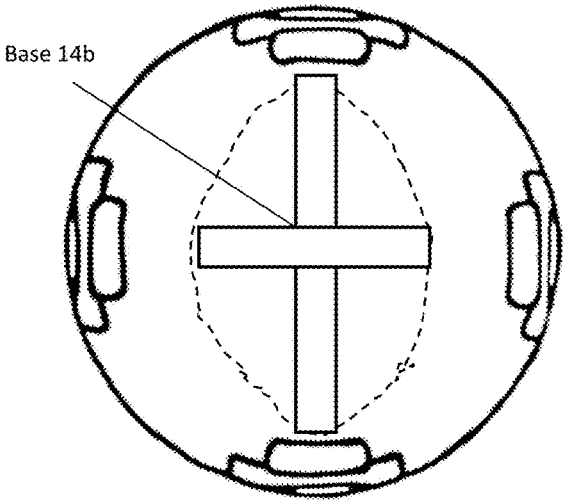
FIG. 1B

BALANCE BOARD FOR EXERCISE AND PHYSICAL THERAPY

RELATED APPLICATION

The present application claims the filing benefit of U.S. Provisional Application No. 62/158,081 titled "Balance Board For Exercise And Physical Therapy" and filed on May 7, 2015. The '081 Provisional Application is hereby incorporated by reference.

TECHNICAL FIELD OF INVENTION

The invention of the present application relates to devices for facilitating individual exercise and physical therapy.

BACKGROUND OF THE INVENTION

Physical therapy and the exercise equipment industry are growing areas where health-minded individuals can find many devices, systems and methods for training, exercising and rehabbing injuries. Many of the known training and/or rehabbing devices can vary in effectiveness, as well as cost.

One popular and useful device is known as a balance board. The balance board comes in many different shapes and sizes. Therapists have also devised a number of exercises for its use. The different exercises are prescribed depending on the intended area (e.g., muscle group, joint, etc.) to be worked on.

A balance board should provide a user with the ability to balance in a standing position through full range of motion along the frontal and sagittal planes, without having to dismount the board. These devices should also include a feature to allow the user to maintain an inverted position of the ankle and move through full active ankle dorsiflexion and plantar flexion range of motion in a weight bearing position to strengthen the ankle in a position that most ankle sprains occur. A user should also be able to utilize the board at two different intensities in prone shoulder stabilization exercises.

Despite the need for these features, current balance boards do not provide the ability to balance in a standing position through full range of motion along the frontal and sagittal planes without having to dismount the board. These devices also lack a feature which allows the user to maintain an inverted position of the ankle and move through full active ankle dorsiflexion and plantar flexion range of motion in a weight bearing position to strengthen the ankle in a position that most ankle sprains occur. Furthermore, known prior art devices do not allow the user to utilize the board at two different intensities in prone shoulder stabilization exercise.

Currently, a device known as a "rocker board" is widely used for balance exercises. The device has two rails set wide apart. The user must dismount the rocker board, rotate the board 90 degrees, and remount the board in order to balance along both the frontal and sagittal planes. The rocker board does not allow the user to reach full range of motion across both planes.

A small sphere attached to a round board has been described as useful for balance exercises. The small diameter of the sphere tends to make the board unstable and too advanced for most users. Also, the round board makes the device difficult to mount against the flat surface of the floor without external support.

The Indo™ board, and similar devices, allow the user to balance through full range of motion along the frontal plane, but do not allow the user to balance along the sagittal plane.

The BOSU® ball includes a firm flat surface with a hemispherical bladder affixed centered on the bottom and has been used for balance training. The BOSU® ball can be used in standing balance with the bladder against the ground and the user may balance in any direction. But, because the bladder is spherical the user cannot balance through full range of motion along the sagittal plane in the anatomical standing position.

The invention of the present application is designed to address these and other issues faced by balance board users. The disclosed device provides a user-friendly exercise and physical therapy balance board with numerous advantages in simplicity and effectiveness.

SUMMARY OF THE INVENTION

There is disclosed herein an improved balance board which avoids the disadvantages of prior devices while affording additional structural and operating advantages.

Generally speaking, the balance board is comprised of a frame, a base mounted to the frame and a plurality of stops positioned on the frame. The frame includes an upper and lower surface and at least one pair of hand slots extending through the frame proximate a periphery. The base has one of either a prolate spheroid shape or a truncated prolate spheroid shape, and is centered on and secured to the lower surface of the frame. Finally, the plurality of stops are positioned on the frame with one stop proximate each hand slot and extending from the lower surface a distance sufficient to provide a gap for a user's hand as it extends through a hand slot.

In a specific embodiment, the shape of the base is achieved by using a first rail positioned within a frontal plane of the board and a second rail positioned within a sagittal plane of the board. For stability and integrity, two additional rails positioned may be positioned on opposite ends of the first rail and parallel to the second rail. During use, these added rails allow the user to maintain inversion of the ankle and move through plantar flexion and dorsiflexion.

In a particularly preferred embodiment, a utilized portion of the first rail is longer than a utilized portion of the second rail, though the actual length of the first rail is shorter than the actual length of the second rail.

Preferably, as both the first rail and the second rail are contoured to allow a rocking motion of the balance board in at least two directions, the contour of the second rail has a greater arc angle than the contour of the first rail.

In another specific embodiment, the disclosed balance board comprises a base having a rounded contour along at least one plane, a frame having upper and lower surfaces and being secured to the base at the lower surface, the frame including at least one pair of hand openings extending through the frame, and a stop positioned on the frame and extending toward the lower surface a distance sufficient to protect a user's hand extending through an opening.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings, embodiments of a device from an inspection of which, when considered in connection with the following description, the subject matter sought to be protected, its construction and operation, and many of its advantages should be readily understood and appreciated.

FIG. 1A is a bottom side view showing a general shape for a first embodiment of a base for the disclosed balance board;

FIG. 1B is a bottom side view showing a general shape for the base similar to that of FIG. 1 (dash-lined shape), but using only two rails;

DETAILED DESCRIPTION OF PREFERRED EMBODIMENTS

Figure 2:
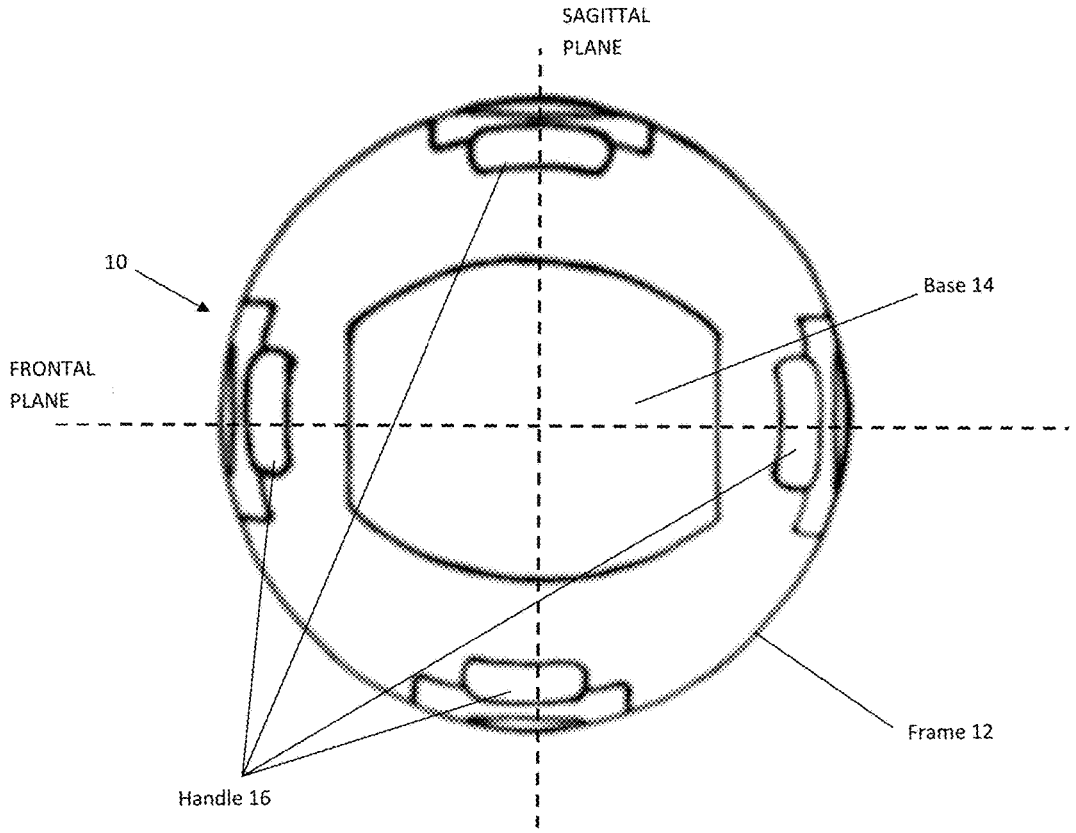
FIG. 2 is a bottom view showing a general shape for a second embodiment of a base for a balance board.

While this invention is susceptible of embodiments in many different forms, there is shown in the appended FIGS. and will herein be described in detail, at least one preferred embodiment of the invention with the understanding that the present disclosure is to be considered as an exemplification of the principles of the invention and is not intended to limit the broad aspect of the invention to any of the specific embodiments illustrated.

Referring to FIGS. 1-17, there is illustrated a balance board, generally designated by the numeral 10. The particular illustrated balance board 10 may be for a specific sized user, such as an adult male. However, while all the embodiments illustrated may be directed for use by an adult male, for example, it should be understood that the principles of the invention can be more broadly applied to balance boards for any size and type user, including children and elderly, wherein the board allows a user to move through a full range of motion—though some users may not be able to achieve his or her potential full range of motion at any given time due to other physical constraints.

Generally speaking, the board 10 is comprised of a frame 12 having two substantially flat surfaces, e.g., upper surface 30 and lower surface 32, and a base 14 affixed to the lower surface 32. The frame 12 includes a plurality of handles 16 thereon with safety stops 18 proximate each handle. In use, the base 14 is positioned in contact with the floor (or a flat supporting surface) and the user mounts the frame 12 of the board 10 in any number of positions by either standing on the upper surface 30 of the frame 12 or grasping the handles 16, and then moving along the contour of the base 14 by shifting weight.

As can be seen in the embodiment of FIG. 1A, the base 14*a* of board 10 has a prolate spheroid (e.g., football) shape. The illustrated base 14*a* of FIG. 1A is a full-bodied component having a smooth, rigid surface about the entirety of the base 14. However, as shown in FIG. 1B, the base 14*b* can be most simply created using two flat-edged beams or rails that are preferably about two inches (5.1 cm) wide and properly contoured, with one beam running along the frontal plane, one running along the sagittal plane, and both intersecting at their respective midpoints in the center of board 10. The base of FIG. 1A is shown in dashed lines superimposed over the two rail base 14*b* of FIG. 1B. As can be seen, the construction of base 14*b* in FIG. 1B has four open areas instead of the smooth complete surface of the base 14*a* illustrated in FIG. 1A. The preferred embodiment of the board 10 would include a fully-formed base in any of the disclosed final shapes/forms.

Figure 3:
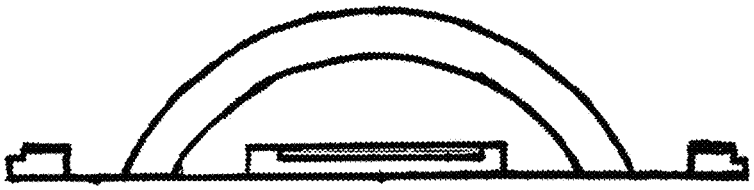
FIG. 3 is a side view of an upside-down balance board showing the base of FIG. 2 looking along the frontal plane axis.

As shown in FIGS. 2 and 3, a second embodiment of base 14 uses a truncated prolate spheroid shape (e.g., a football with both ends cut off). The truncation of each end of the base 14 along the frontal plane merely removes an otherwise unusable portion due to the impact of stops 18 with the floor. This does not necessarily affect the operation of the board 10, but can directly attribute to a material cost savings in construction of the board 10. Construction of this embodiment is similar to that of the base 14*b* described above, including a single rail 20 along the frontal plane and a second rail 22 along the sagittal plane. Though not shown, the second rail 22 along the sagittal plane can also be truncated to reduce material cost without affecting the board performance.

Figure 4:
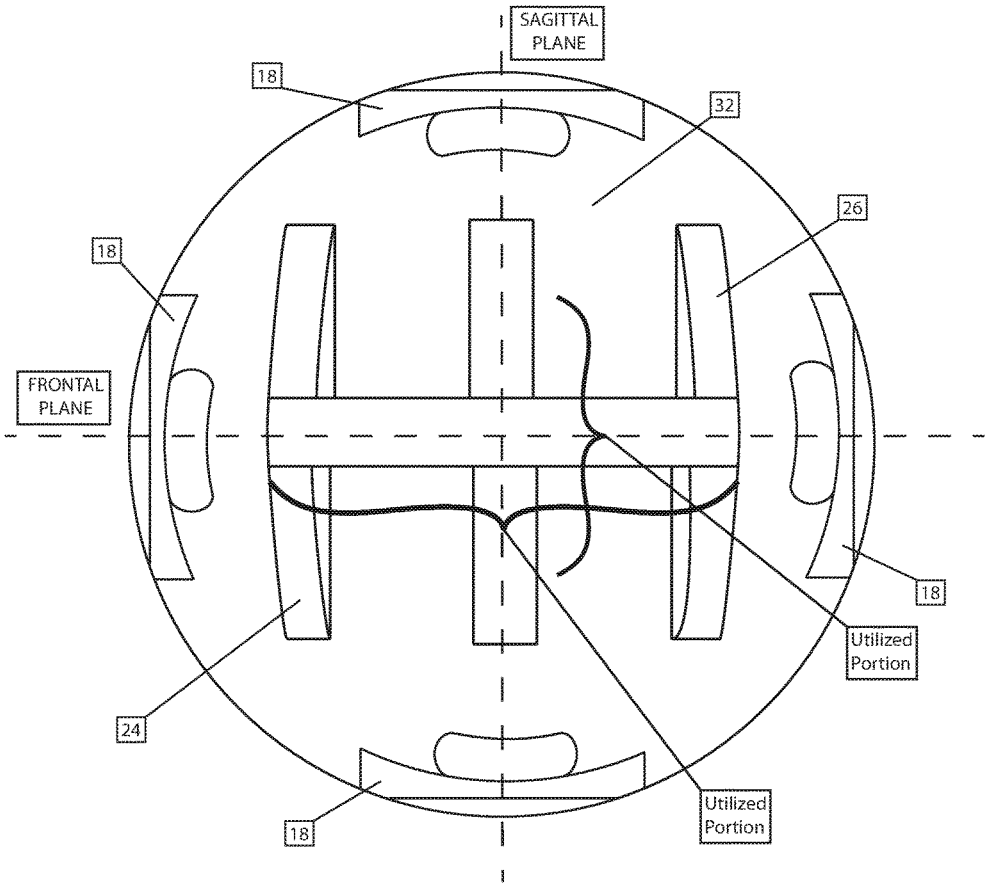
FIG. 4 is a bottom view of the disclosed balance board showing a third possible embodiment for a base similar to the base of FIG. 2.
Figure 5:
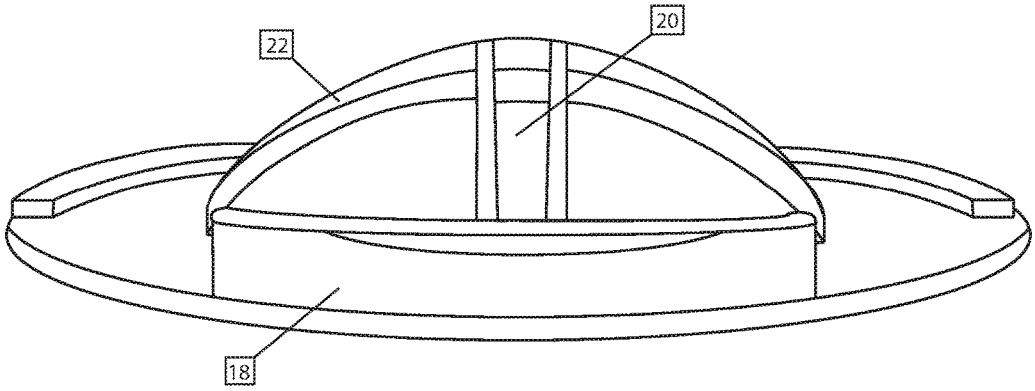
FIG. 5 is a side view of an upside-down balance board showing the base of FIG. 4 along the frontal plane axis.
Figure 6:
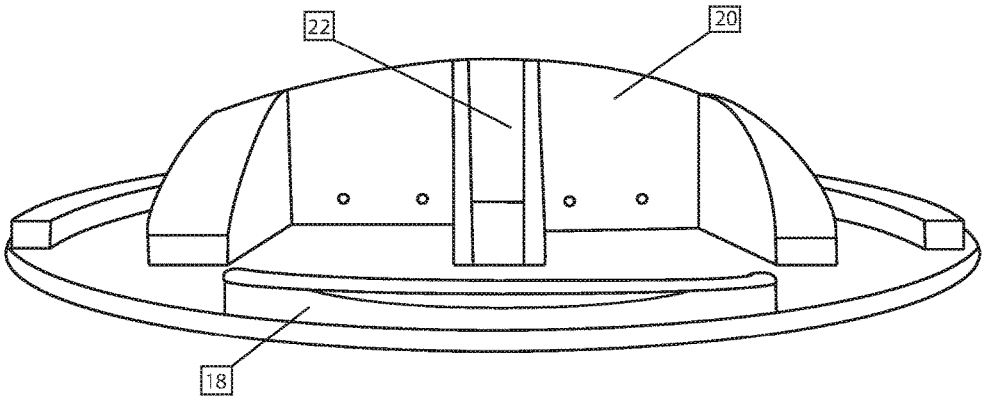
FIG. 6 is a front view of an upside-down balance board showing the base of FIG. 4 along the sagittal plane axis.

As shown in FIGS. 4-6, two additional rails, 24 and 26, parallel to the sagittal plane rail 22 are positioned at each end of the frontal plane rail 20. The added rails provide greater stability for the user, as well as a stronger construction for the base 14. During use, rails 24 and 26 allow the user to maintain inversion of the ankle and move through plantar flexion and dorsiflexion, as explained further below.

Each rail of the disclosed board 10 has a portion of the two-inch wide flat-edge contour (i.e., surface length) which actually is capable of contact with the support surface (e.g., floor) onto which the board 10 is positioned during an exercise. This is referred to as the "utilized portion" of the rail. In the illustrated embodiment of FIG. 2, the "utilized portion" of the frontal plane (or first) rail 20 is longer than the "utilized portion" of the sagittal plane (or second) rail 22, though the shorter sagittal plane rail 22 may actually have a greater surface length due to using a greater arc length. The "utilized portion" for both the frontal plane rail 20 and sagittal plane rail 22 may be limited at both due to interference with the handles 16, which is why the ends of either or both rails may be truncated.

As illustrated, the arc angle used to create the frontal plane rail 20 is smaller than that of the sagittal plane rail 22, as the frontal plane rail 20 is of an arc from a much larger circle. The length of each rail is intended to accommodate a fuller range of motion along each plane for a user.

Of course, by changing any of the dimensions of the two rails (e.g., arc angle, arc length, etc.) before construction of a balance board 10 will alter the ratio of utilized portion of the rail length along the frontal plane to the utilized portion of the rail length along the sagittal plane. This can be done to achieve different "effort levels" for different boards, if desired. These alterations (and others) are considered to fall within the scope of the present application.

Using only the two flat beams or rails, 20 and 22, along the shape of the base makes it possible for a user to maintain balance throughout the range of motion, but only being two inches wide challenges the user to balance along the direction of the rail, as well as perpendicular to it. For example, as a user balances along the frontal plane rail 20 (i.e., side-to-side balance), the user must also maintain balance in the sagittal plane (i.e., front-to-back balance), to retain position on the board 10. As a user returns to a neutral position on the board 10 (i.e., the point of intersection of both rails, 20 and 22) he or she may continue along the current plane or change directions to move along the sagittal plane rail 22 without having to dismount the board 10.

Figure 7:
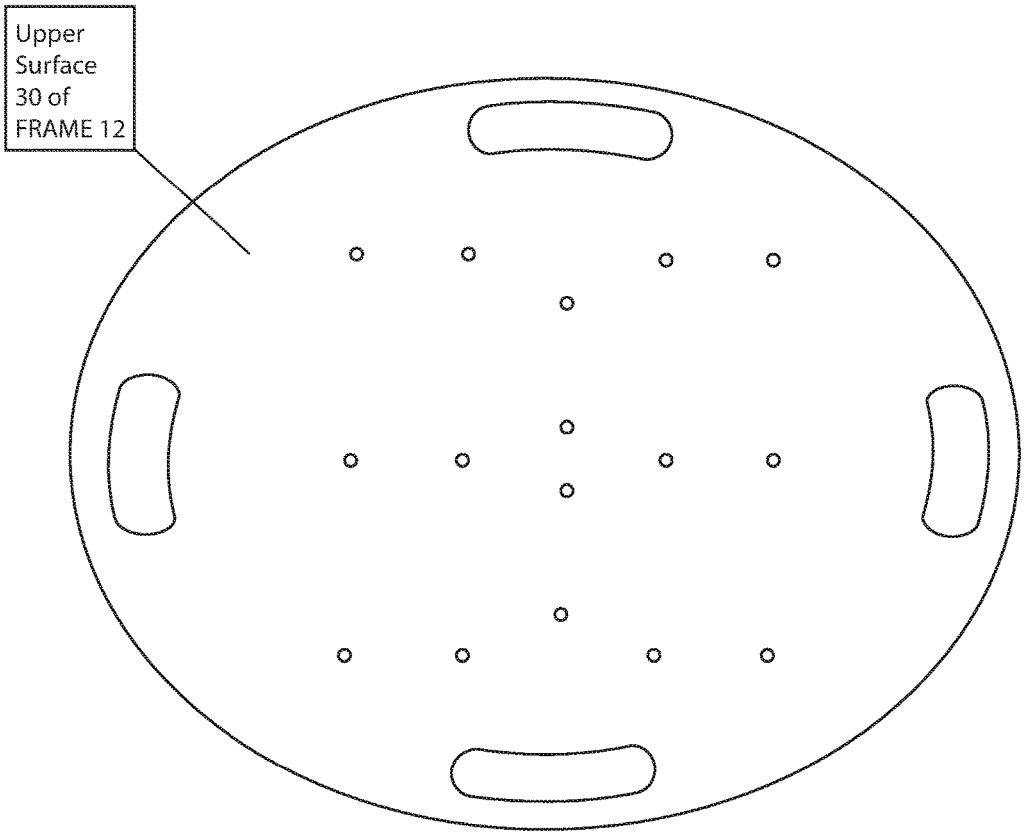
FIG. 7 is top view of an embodiment of the disclosed balance board.
Figure 8:
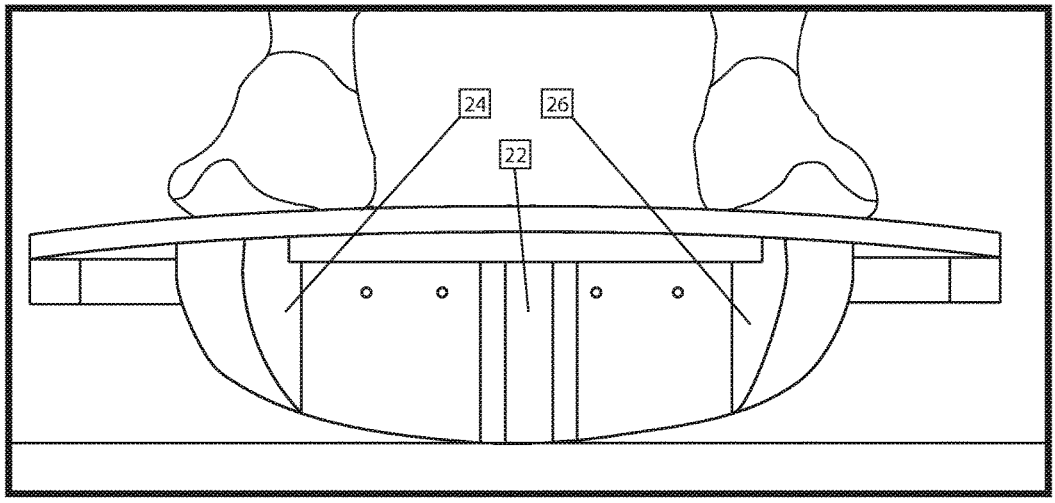
FIG. 8 is front view of the disclosed balance board in a neutral position.
Figure 9:
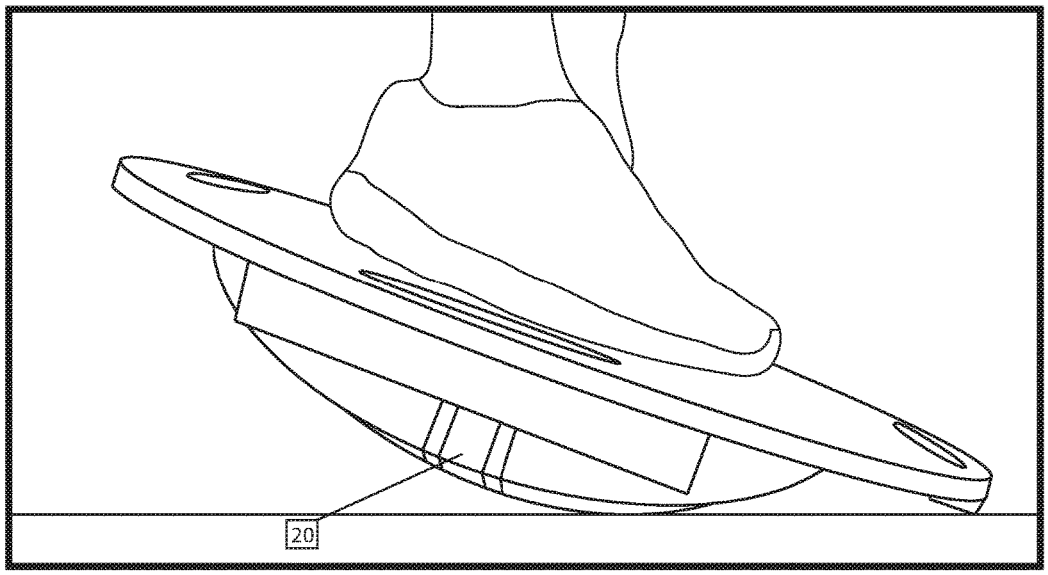
FIG. 9 is side view of the disclosed balance board in an anterior position.
Figure 10:
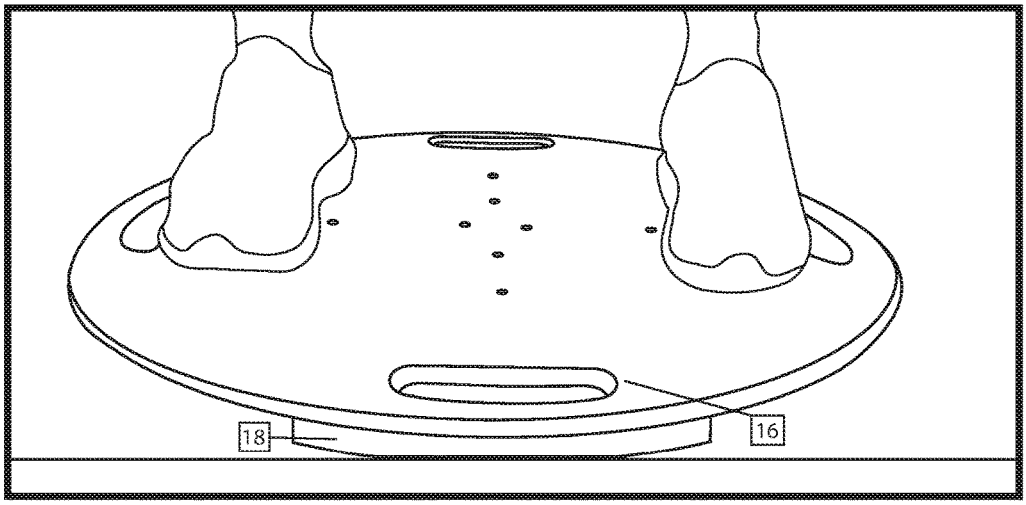
FIG. 10 is a front view of the balance board illustrated in FIG. 9.
Figure 11:
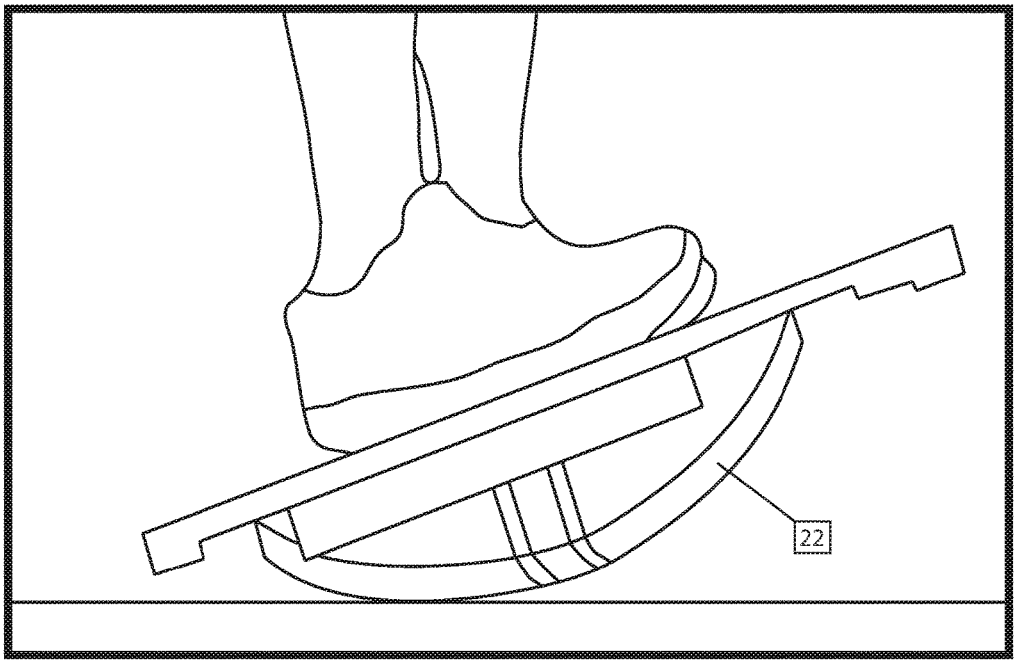
FIG. 11 is a side view of the disclosed balance board in a posterior position.
Figure 12:
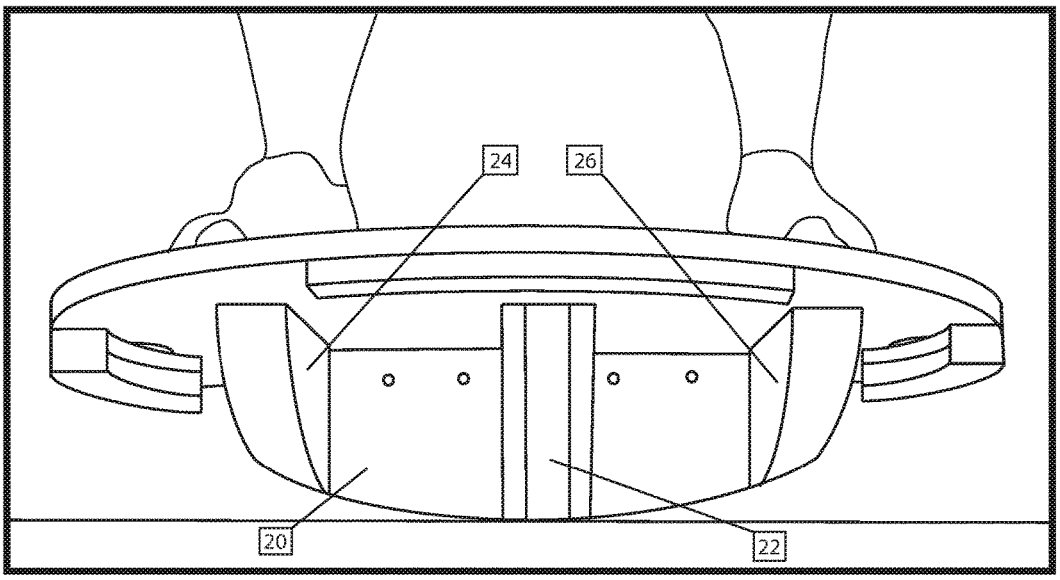
FIG. 12 is a front view of the balance board illustrated in FIG. 11.
Figure 13:
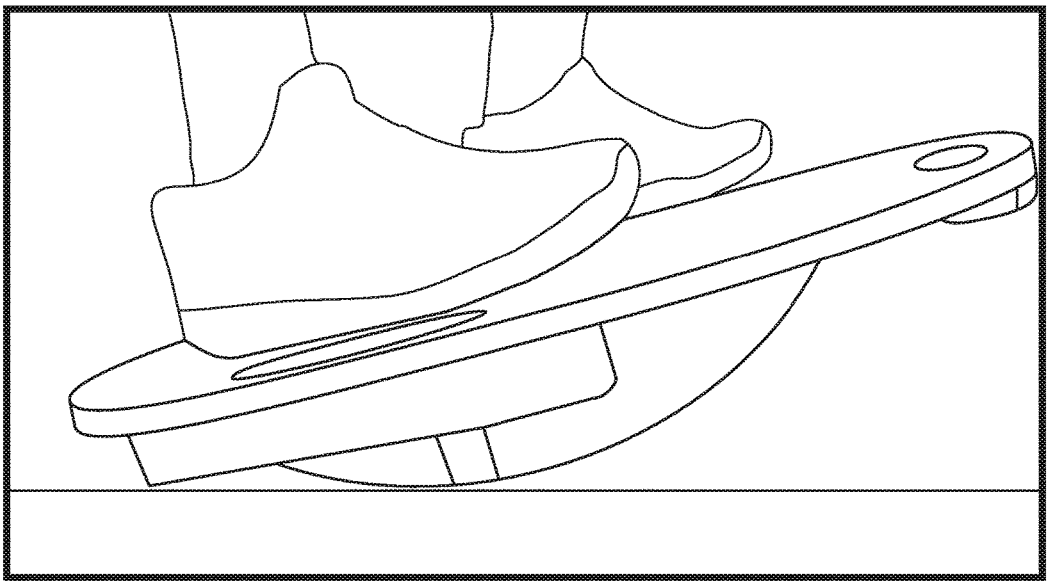
FIG. 13 is a side view of the disclosed balance board in a posterolateral position.
Figure 14:
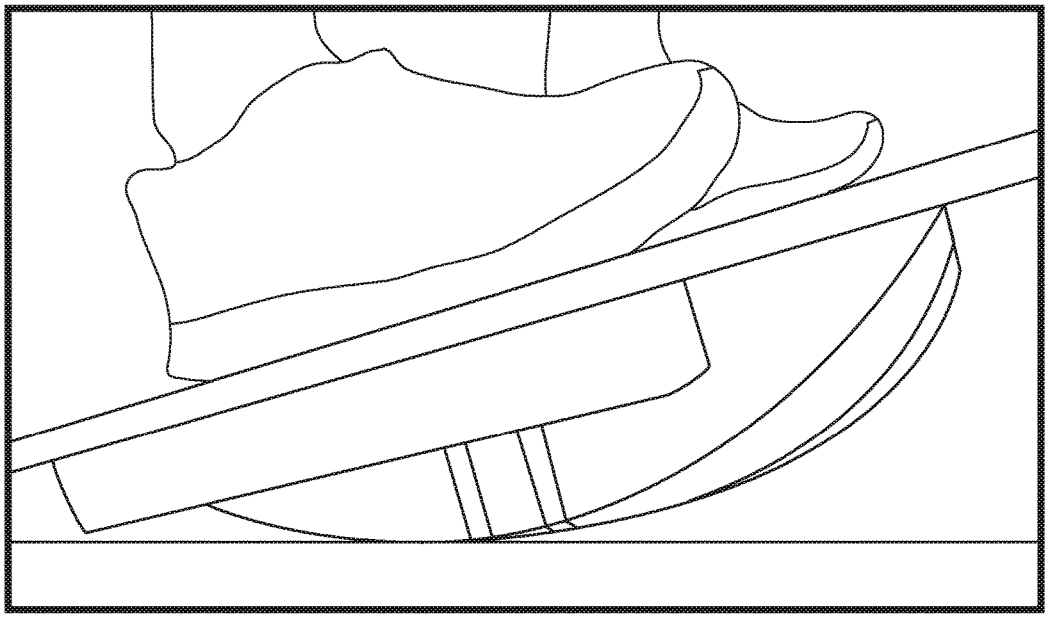
FIG. 14 is a close-up view of the posterolateral position illustrated in FIG. 13.
Figure 15:
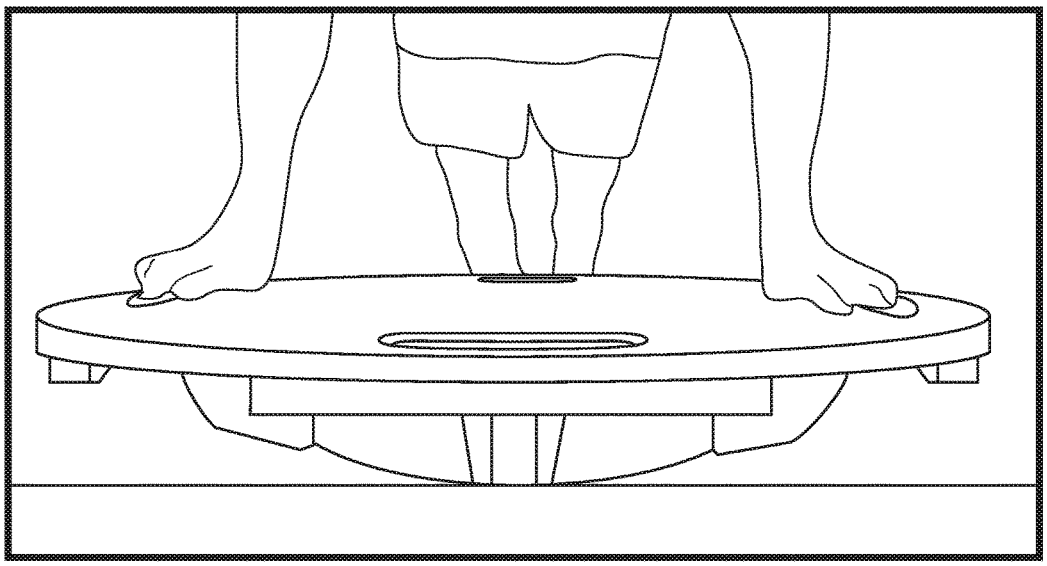
FIG. 15 is a side view of the disclosed balance board in a prone neutral position.
Figure 16:
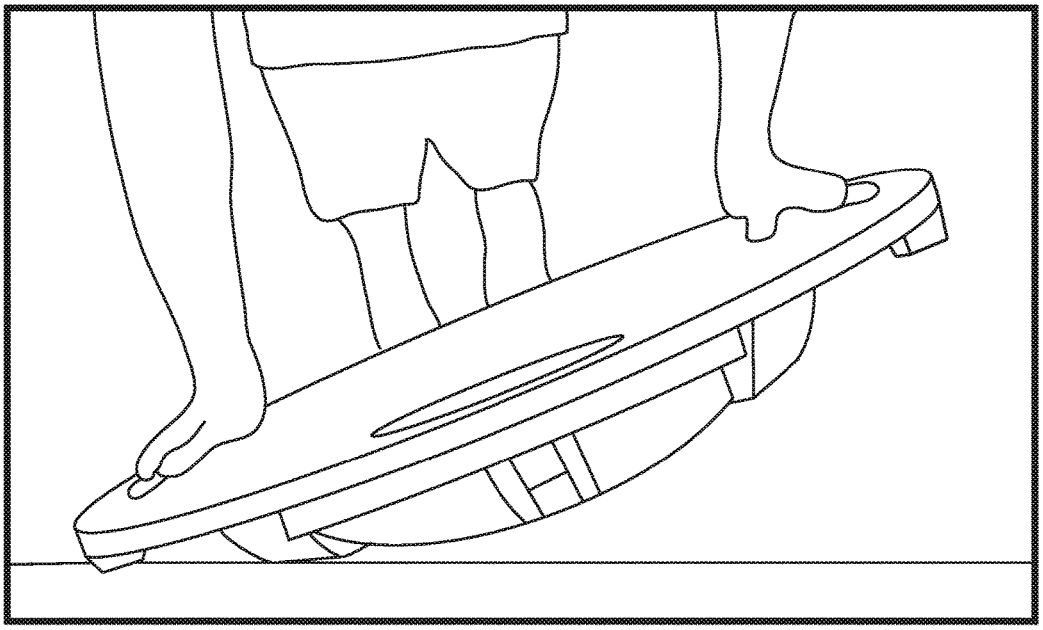
FIG. 16 is a side view of the disclosed balance board in a prone lateral position.
Figure 17:
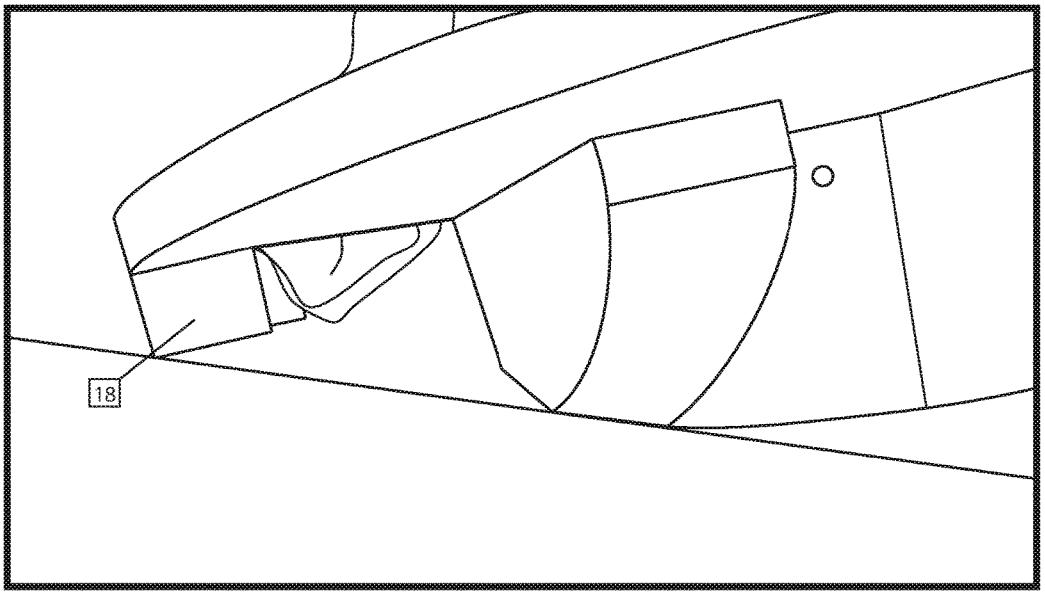
FIG. 17 is close-up view of an embodiment of a protective stop feature located at a handhold of the disclosed balance board.

In addition to the base 14, a disc-like frame 12 is also an important component of the board 10, as shown in FIG. 7. The frame 12 preferably includes four handles 16, which are basically shown as open slots on the frame 12, though two handles 16 may be sufficient for some uses. The handles 16 are preferably aligned with the frontal and sagittal plane rails, 20 and 22. Protective stops 18, as shown in FIGS. 5 and 6, are preferred to prevent smashing the fingers of the user during prone position exercises. The stops 18 preferably extend from the under lower surface 32 of the frame 12 such that they contact the floor (or other surface) leaving a gap for the user's fingers (see FIG. 17).

With any of the above-disclosed base configurations, the balance board 10 may be used by a user in a standing position or from a prone position, depending on the target area to be worked. In all configurations the user is permitted, while in a standing position, to move along the frontal plane and the sagittal plane, switching from one to the other, without dismounting the board 10. From the prone position, movement along the sagittal plane, though possible, is not typically used due to the demand on the user's wrists. However, the present board 10 allows a quick change in intensity for the prone user by merely rotating the board 90 degrees—i.e., the sagittal plane becomes the frontal plane.

From a standing position, referring to FIGS. 8-14, as a user progresses laterally along the frontal plane rail 20 the respective ankle moves further into inversion and the user can move the board anteriorly (FIGS. 9-10) and posteriorly (FIGS. 11-12) along the surface of the base to functionally strengthen the ankle in the position in which most ankle sprains occur.

As described previously, two pairs of handles (e.g., slots) 16 through the frame 12 of the board 10 are formed approximate the periphery and can be used in the prone position for shoulder stabilization exercises. With the arc of each rail, 20 and 22, being of a different size, two different intensities are provided for utilization in the prone position—i.e., along the frontal plane and along the sagittal plane. Though the frontal plane rail 20 of FIG. 2 does not complete a full arc to the lower surface 32 of the frame 12 as a result of being truncated, but the entire useable range of the rail remains.

As previously noted, the purpose of the truncation of the frontal plane rail 20 is to provide space for the user's fingers when used in the prone position. When the user reaches the end range along either plane the board will hit the flat edge stop 18 that projects from the underside of the frame 12, located laterally from the slots or handles 16. Additionally, the stops 18 also provide a flat edge that serves to make the board 10 easier to mount and easier for the user to maintain position on the board when taken to the end range. With a flat edge meeting the flat ground the board is more stable than the round edge of many other boards that come in contact with the ground. With the stop being projected from the underside of the board at a position lateral to the handles it also prevents the user's fingers from being compressed against the ground when used in the prone position.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

The invention claimed is:

1. A balance board comprising:

a frame having an upper and lower surface and including at least one pair of hand slots extending through the frame proximate a periphery;

a base comprised of a first rail positioned within a frontal plane of the board, a second rail positioned within a sagittal plane of the board, and two additional rails positioned at opposite ends of the first rail and parallel to the second rail, and the base being structured to generally form one of either a prolate spheroid shape or a truncated prolate spheroid shape, the base being centered on and secured to the lower surface of the frame; and a plurality of stops positioned on the frame with one proximate each hand slot and extending from the lower surface a distance sufficient to provide a gap for a user's hand extending through each hand slot.

2. The balance board of claim 1, wherein the frame includes four hand openings with two aligned on the frontal plane of the board and two aligned on the sagittal plane of the board.

3. The balance board of claim 1, wherein a utilized portion of the first rail is longer than a utilized portion of the second rail.

4. The balance board of claim 3, wherein the surface length of the first rail is shorter than the surface length of the second rail.

5. The balance board of claim 4, wherein both the first rail and the second rail are contoured and the contour of the second rail has a greater arc angle than the contour of the first rail.

6. A balance board comprising:

a frame having an upper surface and a lower surface; and a base affixed to the lower surface of the frame and comprising a first contoured rail positioned along a frontal plane of the board, a second contoured rail positioned along a sagittal plane of the board, and two rails positioned at opposite ends of the first rail and parallel to the second rail;

wherein the first rail has a utilized portion defined as a portion of surface length of the first rail capable of use during an exercise, the second rail has a utilized portion defined as a portion of surface length of the second rail capable of use during an exercise, the rails intersect at a center of the board, the length of the utilized portion of the first rail is longer than the length of the utilized portion of the second rail, and the surface length of the first rail is shorter than the surface length of the second rail.

7. The balance board of claim 6, wherein the frame includes four hand openings with two aligned on the frontal plane and two aligned on the sagittal plane.

8. The balance board of claim 6, wherein the second contoured rail has a greater arc angle than the first contoured rail.

9. A balance board comprising:

a frame having an upper surface and a lower surface; and a base affixed to the lower surface of the frame and comprising a first contoured rail positioned along a frontal plane of the board and a second contoured rail positioned along a sagittal plane of the board;

wherein the frame includes four hand openings with two aligned on the frontal plane and two aligned on the sagittal plane, the first rail has a utilized portion defined as a portion of surface length of the first rail capable of use during an exercise, the second rail has a utilized portion defined as a portion of surface length of the second rail capable of use during an exercise, the rails intersect at a center of the board, the length of the utilized portion of the first rail is longer than the length of the utilized portion of the second rail, and the surface length of the first rail is shorter than the surface length of the second rail.

10. The balance board of claim 9, wherein the base is further comprised of two rails positioned at opposite ends of the first rail and parallel to the second rail.

11. The balance board of claim 9, wherein the second contoured rail has a greater arc angle than the first contoured rail.

* * * * *